US005522288A

United States Patent [19]

Slusar et al.

[11] Patent Number: 5,522,288

[45] Date of Patent: Jun. 4, 1996

[54] REVERSIBLE RATCHET WRENCH

[75] Inventors: Randall J. Slusar, Greenfield; William A. Nurmi, Racine, both of Wis.

[73] Assignee: Snap-on Incorporated, Kenosha, Wis.

[21] Appl. No.: 352,369

[22] Filed: Dec. 9, 1994

[51] Int. Cl.[6] ..... B25B 13/46

[52] U.S. Cl. ..... 81/63; 81/63.2

[58] Field of Search ..... 81/63, 63.2

[56] References Cited

U.S. PATENT DOCUMENTS

| | | | |
|---|---|---|---|
| 2,542,241 | 2/1951 | Fors | 81/63 |
| 2,550,775 | 5/1951 | Clark . | |
| 2,697,642 | 12/1954 | Rudy . | |
| 2,718,806 | 9/1955 | Clark . | |
| 2,758,494 | 8/1956 | Jenkins . | |
| 2,808,862 | 10/1957 | Simkins . | |
| 2,957,377 | 10/1960 | Hare . | |
| 3,606,940 | 9/1971 | Finkeldei . | |
| 3,783,703 | 1/1974 | Trimble et al. . | |
| 4,235,269 | 11/1980 | Kraus . | |
| 4,257,507 | 3/1981 | Solomon . | |
| 4,512,218 | 4/1985 | Chow . | |
| 4,699,028 | 10/1987 | Bosque | 81/63 |
| 4,869,138 | 9/1989 | Farris . | |
| 4,873,898 | 10/1989 | Chern . | |
| 4,934,220 | 6/1990 | Slusar et al. | 81/63 |
| 4,986,147 | 1/1991 | Cooper | 81/63.2 |
| 5,010,792 | 4/1991 | Clarno | 81/63 |
| 5,012,705 | 5/1991 | Chow . | |
| 5,115,699 | 5/1992 | Mertens . | |
| 5,157,994 | 10/1992 | Krivec | 81/63 |
| 5,178,047 | 1/1993 | Arnold et al. . | |
| 5,199,330 | 4/1993 | Arnold et al. . | |
| 5,210,895 | 5/1993 | Hull et al. . | |
| 5,211,087 | 5/1993 | Thomason . | |
| 5,255,576 | 10/1993 | Keith | 81/63 |
| 5,259,277 | 11/1993 | Zurbuchen . | |
| 5,309,799 | 5/1994 | Jore . | |

*Primary Examiner*—Bruce M. Kisliuk
*Assistant Examiner*—Joni Danganan
*Attorney, Agent, or Firm*—Emrich & Dithmar

[57] ABSTRACT

A reversible ratchet wrench includes a main body, a drive gear housed within a gear end of the main body, and a pawl assembly housed within a pawl end of the main body. Further included are a reversing lever, a screw for securing the reversing lever to the pawl assembly, and a coverplate for retaining the drive gear and pawl assembly within their respective gear and pawl ends in the main body. The coverplate is coupled to the screw in a way which permits rotation of the reversing lever relative to the coverplate.

17 Claims, 1 Drawing Sheet

10
22
21
2
2
20
80
20
20

23
88
30
31
85
28
82
24
31
85
27
43
29
45
25
29
25
34
60
63
66
87
65
68
89
69
3
3
33
26
41
46
44
48
49
40
110
100
67
26
62
32
34
47
50
51

110
113
114
112
111
115

22
27
34
34
64
71
73
62
63
42
33
70
32
72
64
61
28
34

82
81
84
80
83
86
87
89
73
72
64
61
64
115
110
111
104
100
102
103
101

41
61
28
64
73
34
72
63
42
33
62
32
34

REVERSIBLE RATCHET WRENCH

BACKGROUND OF THE INVENTION

1. Field of the Invention

The present invention relates to reversible ratchet wrenches and, in particular to the disposition and retention of a reversing lever, a pawl, a gear, and a cover plate using a single screw.

2. Description of the Prior Art

The reversible ratchet wrench has been known for many years and there are numerous ratchet tools with varying handles, driver assemblies, pawl assemblies, and reversing levers.

Recently, there has been a demand for a ratchet wrench which has comparatively few separate parts, thus significantly reducing the need for expensive and extensive tooling and parts inventory, which ratchet wrench can also be assembled easily and rapidly by relatively unskilled labor, and for which wrench, repairs and replacement of parts can be easily accomplished.

One such wrench is disclosed in U.S. Pat. No. 5,178,047 to Arnold et al. This wrench reduces the number of separate parts common in prior tools, by eliminating the need for washers and retaining rings, as well as the number of screws needed to join conventional parts, such as the gear assembly, the pawl assembly, and the reversing lever. This is made possible by the cooperative engagement of the pawl and gear assemblies with a uniquely configured reversing lever having a complex geometry. Due to the nature and construction of the cooperating parts, additional parts are obviated. In particular, the Arnold wrench comprises a reversing lever having a top portion, a tab extending outwardly therefrom and a stem depending downwardly from the top portion. The stem is received in a vertical bore in the pawl to permit rotation of the pawl between a first or forward condition and a second or reverse condition. The teeth on the pawl selectively engage the teeth on a gear to permit rotation of the gear, as well as of a socket or other driver connected thereto. The wrench further includes a body having first and second part-circular cavities formed therein and communicating with each other. Through the first and second cavities are received the gear and lever/pawl assemblies, respectively. The unique geometry of the reverse lever relative to the pawl and the gear in combination with a cover plate cooperate to hold the assemblies in their respective cavities, once assembly is completed. The use of the cover plate is important to reduce the entry of dirt into the cavities, as well as to reduce wear and damage to the gear and pawl assemblies, to retain the gear and pawl and to provide a bearing surface therefore.

While the Arnold wrench is an improvement over tools requiring a greater number of cooperating parts, the complex geometry of the reversing lever, the gear and pawl assemblies, and the coverplate makes tooling of individual parts an arduous and expensive process.

SUMMARY OF THE INVENTION

It is a general object of the invention to provide a reversible ratchet wrench which is economical and easy to manufacture.

It is another object of the invention to provide a reversible ratchet wrench the individual parts of which are of a simple geometry, being easy and inexpensive to produce, and minimizing the need for tools in disassembly and replacement of such parts.

These and other features of the invention are attained by providing a reversible ratchet wrench including a main body, a drive gear housed within a gear end of the main body, and a pawl assembly housed within a pawl end of the main body. Further included are a reversing lever, a screw for securing the reversing lever to the pawl assembly, and a coverplate for retaining the drive gear and pawl assembly within their respective gear and pawl ends in the main body. The coverplate is coupled to the screw in a way which permits rotation of the reversing lever relative to the coverplate.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
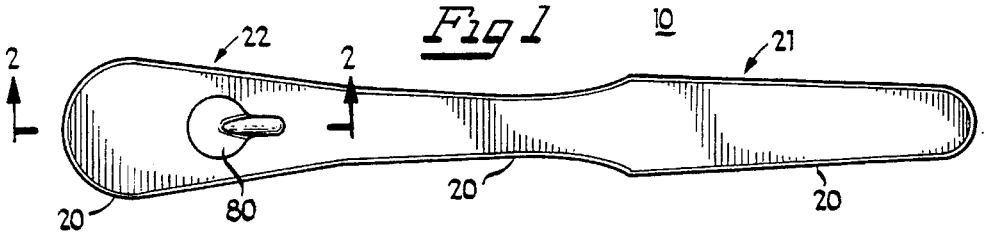
FIG. 1 is a top plan view of a two-direction reversible ratchet wrench constructed in accordance with and embodying the features of the present invention, shown for illustrative purposes with a reversing lever in a position intermediate first and second directional positions.
Figure 2:
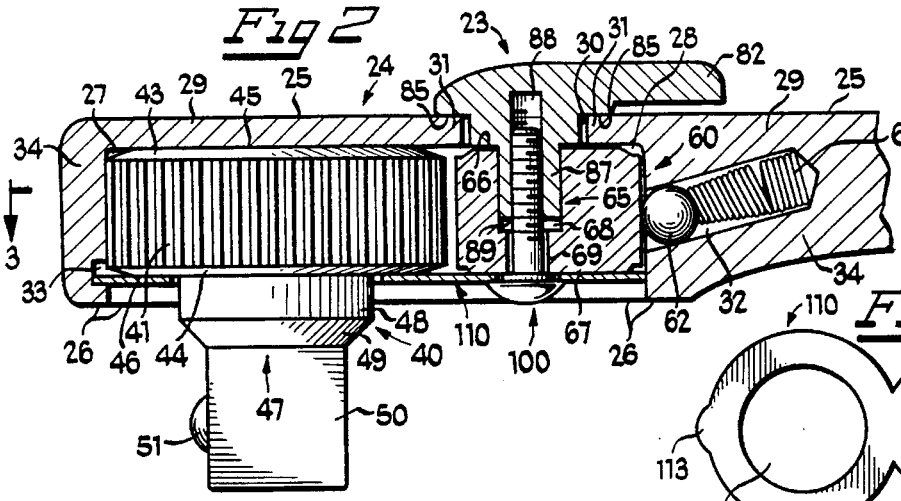
FIG. 2 is an enlarged, fragmentary, vertical, sectional view taken generally along the line 2—2 in FIG. 1.
Figure 3:
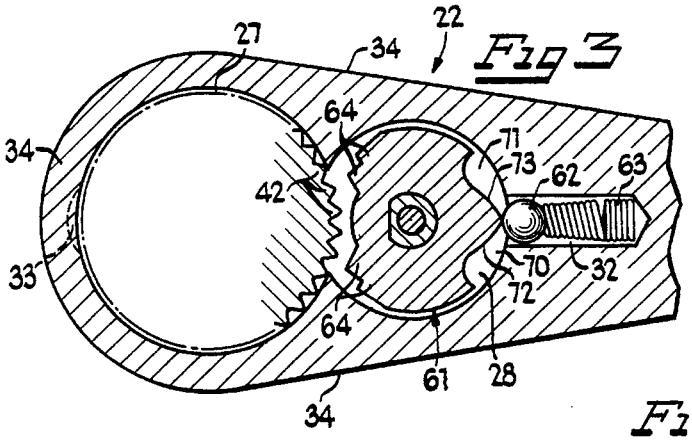
FIG. 3 is a fragmentary, horizontal, sectional view taken along the line 3—3 in FIG. 2.

Referring to FIGS. 1–3, there is illustrated a reversible ratchet wrench generally designated by the numeral 10 and including a main body 20, a drive gear 40, a pawl assembly 60, a reversing lever 80, a self-tapping screw 100 and a coverplate 110, constructed in accordance with and embodying the features of the present invention.

Main body 20 consists of a handle portion 21 and a head portion 22. The head portion 22 includes a pawl end 23 and a drive gear end 24 and is further characterized by a top surface 25 and a bottom surface 26.

Referring to FIG. 3, head portion 22 has two part-circularly cylindrical cavities formed therein. A first cavity 27, distal to the handle portion 21, and a second cavity 28, proximal to the handle portion 21. The cavities 27 and 28 are formed in the bottom surface 26 of the head portion 22 and extend therein toward the top surface 25. The cavities 27 and 28 intersect and communicate with each other and have parallel central axes. The second cavity 28 has a diameter smaller than the diameter of the first cavity 27. The first cavity 27 is closed at the inner end thereof by a wall 29, and is spaced a predetermined distance below the top surface 25 of head portion 22. The second cavity 28 is partially closed at a top end thereof by the same wall 29, but communicates with a coaxial circular opening 30 in the wall 29, of smaller diameter than the diameter of cavity 28. Since opening 30 is smaller than cavity 28, wall 29 forms a shoulder 31 on the top region of cavity 28.

A blind-ended bore 32 is formed in the head portion 22, communicating with the rear end of the cavity 28, a slight distance above the bottom surface 26 and inclined upwardly toward the top surface 25. A slot 33 is formed in the inner surface of a distal end portion of a peripheral side wall 34 of drive gear end 24, a fixed distance up from the bottom surface 26, as shown in FIG. 2.

The drive gear 40 is disposed within the drive gear end 24 of head portion 22, which drive gear end 24 is defined by the first cavity 27, slot 33 and corresponding surrounding wall 29. Drive gear 40 has a substantially cylindrical gear portion 41 with a diameter slightly smaller than the diameter of first cavity 27. A plurality of teeth 42 are uniformly spaced apart about the circumference of the gear portion 41. The teeth 42 are parallel to the axis of the first cavity 27. The flat top and bottom surfaces 45 and 46 of gear portion 41 are beveled or chamfered, as at 43 and 44, around the circumference thereof. Flat surface 45 abuts the inner surface of wall 29. From flat surface 46 extends a drive portion 47 consisting of a cylindrical wall 48, frustoconical wall 49, and a drive lug 50, which lug is substantially square in transverse cross section, but may have other shapes, and is formed and dimensioned to be received in a conventional socket wrench (not shown). Also, the body of lug 50, may include a detent ball 51 to retain a conventional socket wrench thereon in a manner known to persons skilled in the art.

Figure 5:
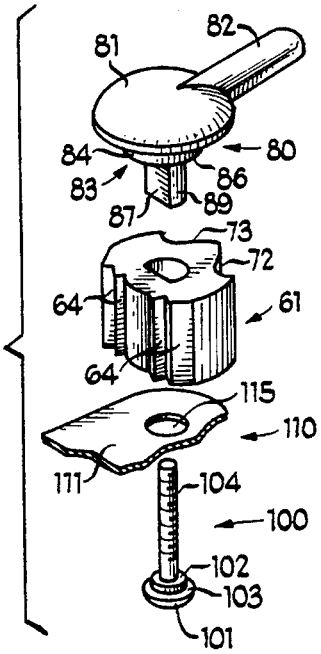
FIG. 5 is an exploded, perspective view of the reversing lever, pawl, screw and coverplate components, with the coverplate shown in partial section.
Figure 4:
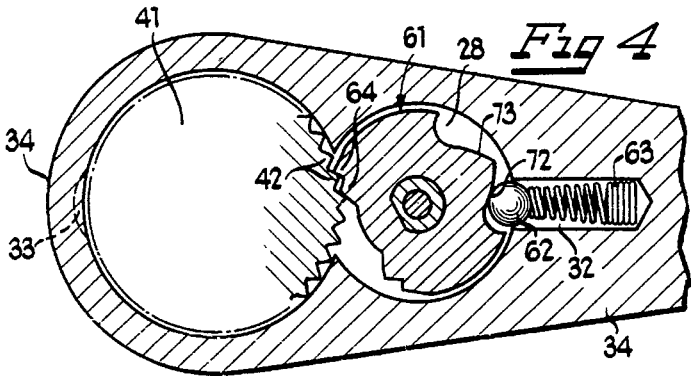
FIG. 4 is a view similar to FIG. 3, but with the reversing lever and pawl assembly in position for rotation in a first direction.

The pawl assembly 60 is disposed within the pawl end 23 of head portion 22, which pawl end 23 is defined by the second cavity 28, the corresponding surrounding wall 29, opening 30, corresponding surrounding end wall 34 and by blind-ended bore 32. Referring also to FIG. 5, the pawl assembly 60 includes a partially cylindrical pawl 61, a ball 62, and a spring 63. A forward portion of the pawl 61 has two sets of spaced apart teeth 64 formed thereon. The teeth 64 on the pawl 61 extend the entire height of the pawl parallel to the axis of the second cavity 28 when the pawl 61 is disposed therein. When so disposed, the teeth 64 of one set of pawl 61 engage the teeth 42 on the gear portion 41. In this manner, when the pawl 61 is in a first condition with the teeth 64 of the one set engaging the teeth 42 on the gear portion 41, as shown in FIG. 4, the gear portion may rotate in a first direction but is prevented from rotating in a second (opposite) direction. Similarly, when the pawl is in a second condition with teeth 64 of the other set engaging the teeth 42 on the gear portion 41, the gear portion 41 may rotate in the second direction but is prevented from rotating in the first (now opposite) direction.

The pawl 61 has a center bore 65 therethrough from a top 66 of the pawl 61 to a bottom 67 of the pawl 61. A top portion 68 of center bore 65 extending from top 66 to a fixed distance from bottom 67 is substantially semicircular while a remaining bottom portion 69 is substantially circular and extends through to the bottom 67 of pawl 61. The pawl 61 further has a pair of spaced-apart pockets 70, 71 formed on the rear end thereof. The pockets are shown extending the entire height of the pawl 61. The ball 62 and the spring 63 resiliently cooperate to position the ball accordingly in one of the pockets 70, 71. When reversing lever 80 is in a position for rotation of the pawl 61 in the first direction, ball 62 will rest on convex wall surface 72 as shown in FIG. 4. Similarly, when the reversing lever 80 is in a position for rotation in the reverse or second direction, the ball 62 will rest on convex wall surface 73. Thus, the ball 62 and spring 63 cooperate with the pockets 70 and 71 to resiliently hold the pawl 61 in either of its two engaged positions in a well-known manner.

A reversing lever 80 is connected to the pawl 61 to effect rotation of the pawl between the first and second conditions. The lever 80 has a substantially cylindrical portion 81 on which a tab 82 is formed extending outwardly therefrom, as shown in FIG. 5. The tab 82 may be textured and/or grooved to reduce slippage when the tab is grasped by a person using the wrench. The lever 80 includes a stem portion 83 extending vertically from the cylindrical portion 81. Stem portion 83 has a cylindrical shoulder 84, depending downwardly from the cylindrical portion 81, and is dimensioned to be received by the opening 30 in head portion 22. The cylindrical shoulder 84 extends into the second circular cavity 28 and is coaxial therewith. The top portion 81 of reversing lever 80 is of greater diameter than that of cylindrical shoulder 84 providing contact surfaces 85 which cooperate with shoulder 31 of wall 29 to prevent the lever 80 from slipping through the opening 30 and second cavity 28. Depending downwardly from a bottom surface 86 of shoulder 84, is a substantially semi-circular base leg 87 which is dimensioned to be received within the top portion 68 of center bore 65 of pawl 60 and is similarly coaxial therewith. The polygonal shape of base leg 87 and mating engagement thereof with pawl 61 causes pawl 61 to rotate together with the reversing lever 80 when tab 82 is rotated in a first direction or in the second direction. The bottom surface 86 of shoulder 84 is coplanar with the top 66 of pawl 61. A cylindrical cavity 88 extends from a bottom 89 of base leg 87 and extends axially into the cylindrical portion 81 thereof. The cavity 88 is coaxial with the axis of second cavity 28 when the lever 80 is disposed in the pawl 61 which, in turn, is disposed in second cavity 28.

The self-tapping screw 100, shown in FIG. 5, includes a head 101, a shoulder 102 extending from a flat surface 103 of head 101, and a threaded circular stem 104. Stem 104 is dimensioned to fit through the bottom portion 69 of bore 65 of pawl 61 and into threaded engagement in cylindrical cavity 88 of base leg 87, thereby coupling pawl 61 and reverse lever 80.

Figure 6:
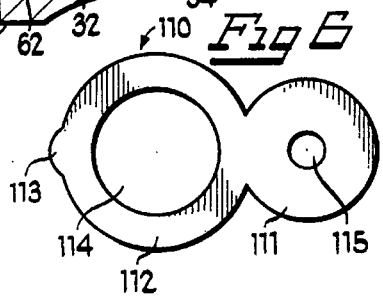
FIG. 6 is a top plan view of the coverplate of FIG. 5.

To restrain the pawl assembly 60 and drive gear 40 within the respective drive gear end 24 and pawl end 23, a coverplate 110 is used. Referring to FIGS. 5 and 6, coverplate 110 is generally a flat member of fixed thickness having two adjoining circular portions in the shape of a numeral eight, the thickness of coverplate 110 being slightly less than the thickness of shoulder 102 of screw 100. One portion 111 is smaller and the other portion 112 is larger. When disposed on the main body 20, the coverplate 110 includes a tab portion 113 dimensioned to be received in slot 33, to permit the coverplate 110 to fit through the opening in bottom surface 26 of the head portion 22 defined by the cavities 27 and 28. The surface of larger portion 112 is coplanar with the flat bottom surface 46 of drive gear 40 and further includes a circular opening 114 having a diameter slightly larger than the diameter of cylindrical wall 48 such that drive portion 47 of drive gear 40 readily extends therethrough. The surface of smaller portion 111 is coplanar with the bottom 67 of pawl 61 and further includes a circular screw-fitting opening 115 having a diameter larger than the diameter of shoulder 102 of screw 100, but smaller than the diameter of head 101. Thus, during installation and assembly, the threaded circular stem 104 extends axially through screw-fitting opening 115, threadedly engaging lever cylindrical cavity 88 and coupling coverplate 110 to pawl end 23 of head portion 22.

Because the thickness of the coverplate 110 is smaller than the height of shoulder 102 of screw 100, and because the diameter of screw-fitting opening 115 of coverplate 110 is smaller than the diameter of head 101 of screw 100, the screw 100 is permitted to rotate freely relative to the coverplate 110. Thus, the coverplate 110 is secured in position by way of the engagement of slot 33 with tab portion 113 at one end (the gear end 24) and by way of the screw 100 locating smaller portion 111 adjacent to the pawl 61.

Thus, a single self-tapping screw operates to fasten the reversing lever 80 to the pawl assembly 60, while simultaneously securing one end of the coverplate 110 to the wrench body 20.

In the preferred embodiment, the screw 100 has been described as a self-tapping screw, i.e., a thread forming screw or a thread cutting screw, which is turned into a smooth, untapped bore of a reversing lever 80. Preferably, therefore, the reversing lever should be of a metallic material softer than the material of the screw, such as a soft zinc die casting. The use of a self-tapping screw ensures that the lever 80 and screw 100 are fixedly secured and unlikely to be unthreaded as a result of lever overuse or wrench abuse.

It is envisioned that a wide variety of functionally equivalent coverplate constructions can be easily substituted for the tab-type construction described in the preferred embodiment. However, the disclosed tab coverplate construction most economically achieves the goal of facilitating installation and minimizing tooling and is therefore preferable to other like constructions.

The single screw construction of the reversible ratchet wrench of the present invention will inevitably result in economical production with the ultimate effect of low retail cost per unit.

Additionally, because the individual parts have a relatively simple geometry, assembly, repair and/or replacement thereof can be easily accomplished.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A reversible ratchet wrench including a main body, a drive gear housed within a gear end of said main body, and a pawl assembly housed within a pawl end of said main body, said wrench further comprising:

a reversing lever;

a threaded fastener for securing said reversing lever to said pawl assembly; and a retaining member cooperating with the main body for retaining the drive gear and the pawl assembly within their respective gear and pawl ends of said main body, said retaining member and said fastener being engageable with said pawl assembly and being threadedly engaged with said receiving lever for securing said bawl assembly in place while permitting rotation of said reversing lever relative to said retaining member.

2. The reversible ratchet of claim 1, wherein said retaining member is a coverplate secured to the main body at said pawl end by said screw.

3. The reversible ratchet wrench of claim 2, wherein the main body has a slot therein at the gear end thereof, said coverplate including a tab portion dimensioned to be received by said slot.

4. The reversible ratchet wrench of claim 3, wherein said screw is a self-tapping screw.

5. The reversible ratchet wrench of claim 2, wherein said screw is a self-tapping screw.

6. The reversible ratchet wrench of claim 1, wherein said screw is a self-tapping screw.

7. The reversible ratchet wrench of claim 1, wherein said reversing lever is disposed on one side of the main body, said fastener entering the main body from a side thereof opposite said reversing lever.

8. The reversible ratchet wrench of claim 1, wherein said reversing lever is disposed on one side of said main body, said retaining member being disposed on an opposite side of said main body.

9. A reversible ratchet wrench including a main body, a drive gear housed within a gear end of said main body, and a pawl assembly housed within a pawl end of said main body, said wrench further comprising:

a reversing lever;

a screw threadedly engaged with said reversing lever for rotation therewith and for securing said reversing lever to the pawl assembly; and a coverplate cooperating with the main body for retaining the drive gear and the pawl assembly within their respective gear and pawl ends of the main body, said screw being engageable with said coverplate for securing said coverplate in place while permitting rotation of said reversing lever relative to said coverplate.

10. The reversible ratchet wrench of claim 9, wherein the main body has a slot therein at the gear end thereof, said coverplate including a tab portion dimensioned to be received by said slot.

11. The reversible ratchet wrench of claim 9, wherein said screw is a self-tapping screw.

12. The reversible ratchet wrench of claim 9, wherein said screw is a self-tapping screw.

13. The reversible ratchet wrench of claim 9, wherein said reversing lever is disposed on one side of the main body, said screw entering the main body from a side thereof opposite said reversing lever.

14. The reversible ratchet wrench of claim 9, wherein said reversing lever is disposed on one side of said main body, said coverplate being disposed on an opposite side of said main body.

15. A reversible ratchet wrench comprising:

a main body including first and second part-cylindrical cavities having parallel axes and communicating with each other and opening at a surface thereof;

a gear member disposed within said first cavity for rotation about the axis of said first cavity;

a pawl assembly including a pawl disposed within said second cavity and having a bore therethrough coaxial with said second cavity and rotatable about the axis of said second cavity between forward and reverse conditions of engagement with said gear member for respectively accommodating rotation of said gear member in forward and reverse directions;

a reversing lever protruding outwardly from said main body and including a stem portion extending axially through said second cavity, and matingly engaged in the bore of said pawl;

a screw having a head portion, a shoulder portion and a stem portion, said screw extending axially into said second cavity and the bore of said pawl for threaded engagement with the stem portion of said reversing lever;

said reversing lever being rotatable to effect rotation of the pawl between the forward and reverse conditions of the pawl; and a coverplate cooperating with said main body for retaining said gear member and said pawl assembly within said main body and having an opening therein for receiving said screw therethrough, said head portion being engageable with said coverplate to secure said coverplate in place, said shoulder engaging said pawl and having an axial thickness greater than the thickness of said coverplate such that said screw rotates freely relative to said coverplate upon rotation of said reversing lever.

16. The reversible ratchet wrench of claim 15, wherein said screw is a self-tapping screw.

17. The reversible ratchet wrench of claim 15, wherein said reversing lever is disposed on one side of said main body, said coverplate being disposed on an opposite side of said main body.

* * * * *

UNITED STATES PATENT AND TRADEMARK OFFICE

CERTIFICATE OF CORRECTION

PATENT NO. : 5,522,288

DATED : June 4, 1996

INVENTOR(S) : Randall J. Slusar and William A. Nurmi

It is certified that error appears in the above-indentified patent and that said Letters Patent is hereby corrected as shown below:

Column 6, line 5, "bawl" should be --pawl--.

Signed and Sealed this

Eighth Day of October, 1996

Bruce Lehman

*Attest:*

BRUCE LEHMAN

*Attesting Officer*

*Commissioner of Patents and Trademarks*